United States Patent [19]

Berger

[11] 4,446,665

[45] May 8, 1984

[54] INSULATED ROOF STRUCTURE SYSTEM AND METHOD OF ERECTING SAME

[75] Inventor: Hans G. Berger, Burlington, Canada

[73] Assignee: The Wickes Corporation, Santa Monica, Calif.

[21] Appl. No.: 326,692

[22] Filed: Dec. 2, 1981

[51] Int. Cl.[3] ..... E04B 1/78; E04B 2/00

[52] U.S. Cl. ..... 52/407; 52/404; 52/478; 52/528; 52/743

[58] Field of Search ..... 52/404, 407, 408, 478, 52/482, 743, 528; 24/255 R, 259 R; 135/119; 160/327, 328, 399, 402

[56] References Cited

U.S. PATENT DOCUMENTS

| | | | |
|---|---|---|---|
| 1,127,074 | 2/1915 | Moulton | 24/259 R |
| 1,496,388 | 6/1924 | Stern | 24/259 R |
| 2,282,631 | 5/1942 | Winship | 52/361 X |
| 2,799,232 | 7/1957 | Jaeger | 52/409 |
| 3,296,761 | 1/1967 | Varlonga | 52/409 X |
| 3,513,614 | 5/1970 | Studzinski | 52/404 X |
| 3,619,437 | 11/1971 | McDonald, Jr. | 264/45 |
| 4,058,949 | 11/1977 | Bellem | 52/478 X |
| 4,075,806 | 2/1978 | Alderman | 52/478 X |
| 4,117,641 | 10/1978 | Wells | 52/478 X |
| 4,147,003 | 4/1979 | Alderman | 52/407 X |
| 4,172,345 | 10/1979 | Alderman | 52/743 X |
| 4,303,713 | 12/1981 | Clemensen et al. | 52/404 X |

*Primary Examiner*—Alfred C. Perham
*Attorney, Agent, or Firm*—Learman & McCulloch

[57] ABSTRACT

A method and a clip system for installing insulation on the purlins of a sheet metal roof construction is disclosed. The clip is of one-piece resilient construction and of a shape to be snapped over a portion of an insulating blanket and the upper portion of a roof purlin to snugly clamp the engaged portion of the blanket against the top and upper opposite sides of the purlin. The blanket is thus contained by the clips below the tops of the purlins so that a pocket suitable for the reception of an unfaced batt of insulating material is formed in the top of the blanket between adjacent purlins. The top of the clip may be provided with suitable means, such as adhesive or projecting barbs, for positively retaining a board of insulating material such as that sold under the trademark, above each purlin and retaining the board against movement during the assembly of overlying roof panels.

12 Claims, 2 Drawing Figures

INSULATED ROOF STRUCTURE SYSTEM AND METHOD OF ERECTING SAME

BACKGROUND OF THE INVENTION

Figure 1:
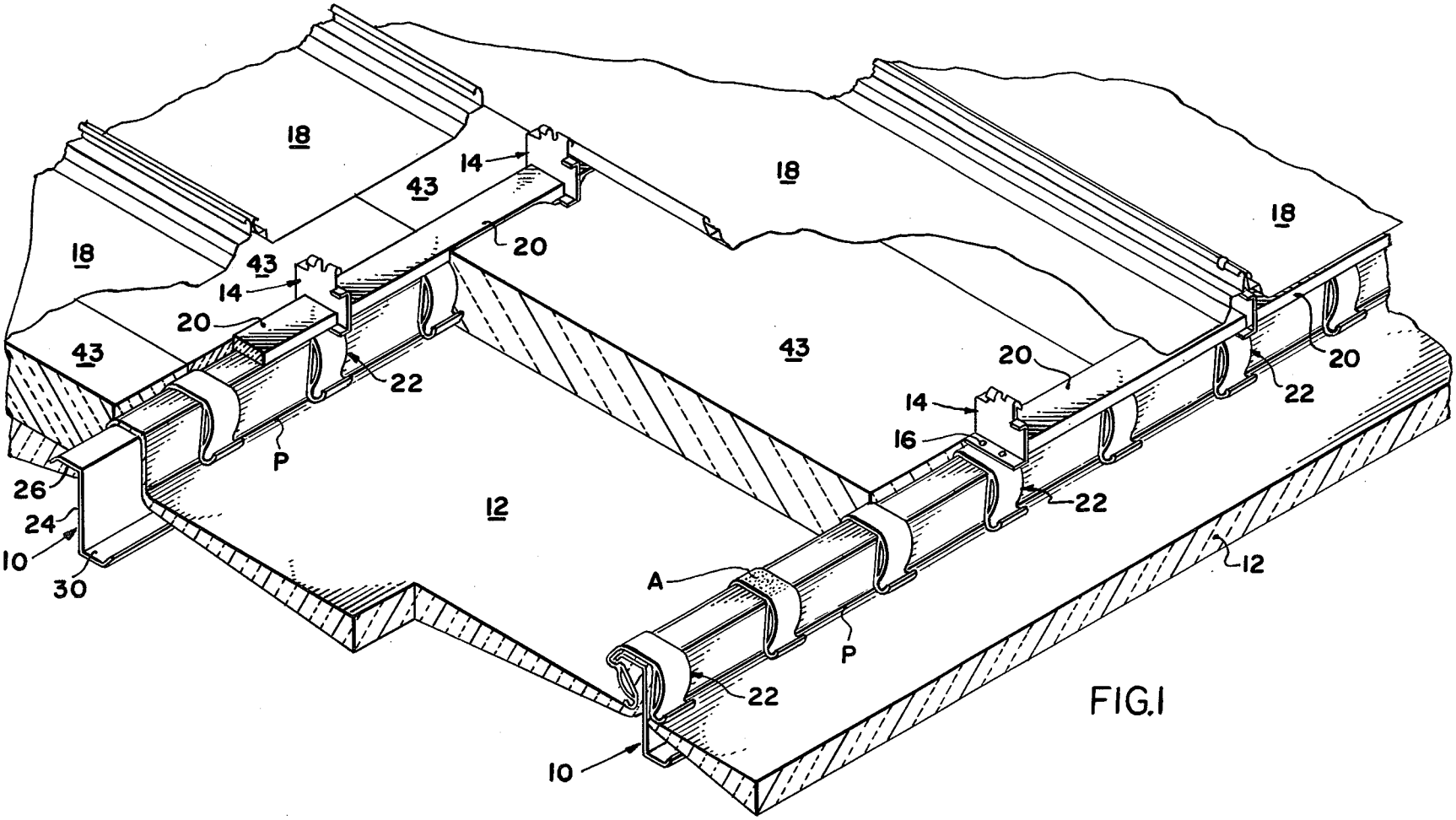

In purlin supported sheet metal roof systems, such as typical standing seam roof constructions, the all metal construction combined with the relatively thin sheet metal roof panels require the inclusion in such roofs of a substantial thickness of heat insulating material. It is known in constructions of this type to install blankets of heat insulating material as the roof is being constructed, normally by laying the blanket of insulating material over the purlins and securing the blanket in place by installing the roof panel mounting clips on top of the blanket, the self tapping screws securing the mounting clips to the purlins passing through the insulating blanket. (See, for example, copending application U.S. Ser. No. 206,822, filed Nov. 14, 1980 and assigned to the assignee of the present application which I incorporate herein by reference).

As pointed out in the aforementioned application, U.S. Ser. No. 206,822, the clamping of the insulating blanket in place by the mounting of the roof panel mounting clips necessarily compresses the blanket along the top of the purlin. Because the blanket must be compressed in this particular type of installation, the thicker the blanket of insulating material employed, the more difficult it becomes to install by this method. As a practical matter, blankets of thickness over six inches pose substantial installation problems where the blanket is to be clamped between the purlin and the roof panel mounting clips. As is recognized in U.S. Pat. No. 4,058,949, "practical considerations limit roof insulation configurations to panels of three to four inches in thickness" for an installation of this type. In U.S. Pat. No. 4,058,949, this problem is solved by employing two layers of relatively thin blankets instead of a single layer thick blanket, however, the double layer blanket installation of U.S. Pat. No. 4,058,949 requires the mounting of a spacer upon the purlins between the two layers to clamp the lower layer to the purlin and to provide a support surface for the upper layer which is held in position by the mounting clip. Other approaches are disclosed in U.S. Pat. Nos. 3,513,614; 4,117,641; 3,511,011; and 4,075,806.

The present invention is especially directed to a resilient clip system which resiliently clamps a relatively thin blanket of insulating material to the purlins in a manner such that the blanket is formed with a depressed pocket between adjacent purlins which is suitable for receiving unfaced batts of insulation material which may be simply placed in position as the roof panels are being installed.

SUMMARY OF THE INVENTION

The upper portion of the typical roof purlin employed in standing seam roof constructions has a transverse cross section in the general shape of an inverted L. The clip utilized with the system of the present invention is formed from a single piece of resiliently bendable plastic or sheet metal material to enclose the inverted L-shaped upper portion of the purlin. It compresses a blanket of insulating material against the top of the purlin and against its two opposite sides for approximately the upper half of the height of the purlin. The clips are installed along each purlin at approximately twelve inch intervals so that the blanket, in its extent between adjacent purlins, is depressed about five inches below the top of the purlins, thus forming a pocket between adjacent purlins into which an unfaced batt of insulating material can be placed to give a substantially increased total thickness of insulation between the purlins.

Because the blanket of insulating material is compressed where it is engaged with the purlin, and the batts of material placed in the blanket pockets formed by the clips of the present invention do not extend over the purlins, a block-like board of a relatively rigid insulating material, such as styrofoam, may be placed over each purlin between adjacent panel mounting clips—see U.S. Pat. No. 4,058,949 and the aforementioned application U.S. Ser. No. 206,822. The clips of the present invention may be provided with suitable means upon their upwardly facing top web, such means taking the form of adhesive or upwardly projecting nipples, to anchor the styrofoam boards in place while the roof panels are being installed. As pointed out in the aforementioned application U.S. Ser. No. 206,822, the boards are ultimately clamped in position by the installation of the roof panels, however, the boards tend to become displaced while the roof panel is being positioned and thus some means for anchoring them during this positioning of the panel is desirable.

Other objects and features of the invention will become apparent by reference to the following specification and to the drawings.

IN THE DRAWINGS

Figure 2:
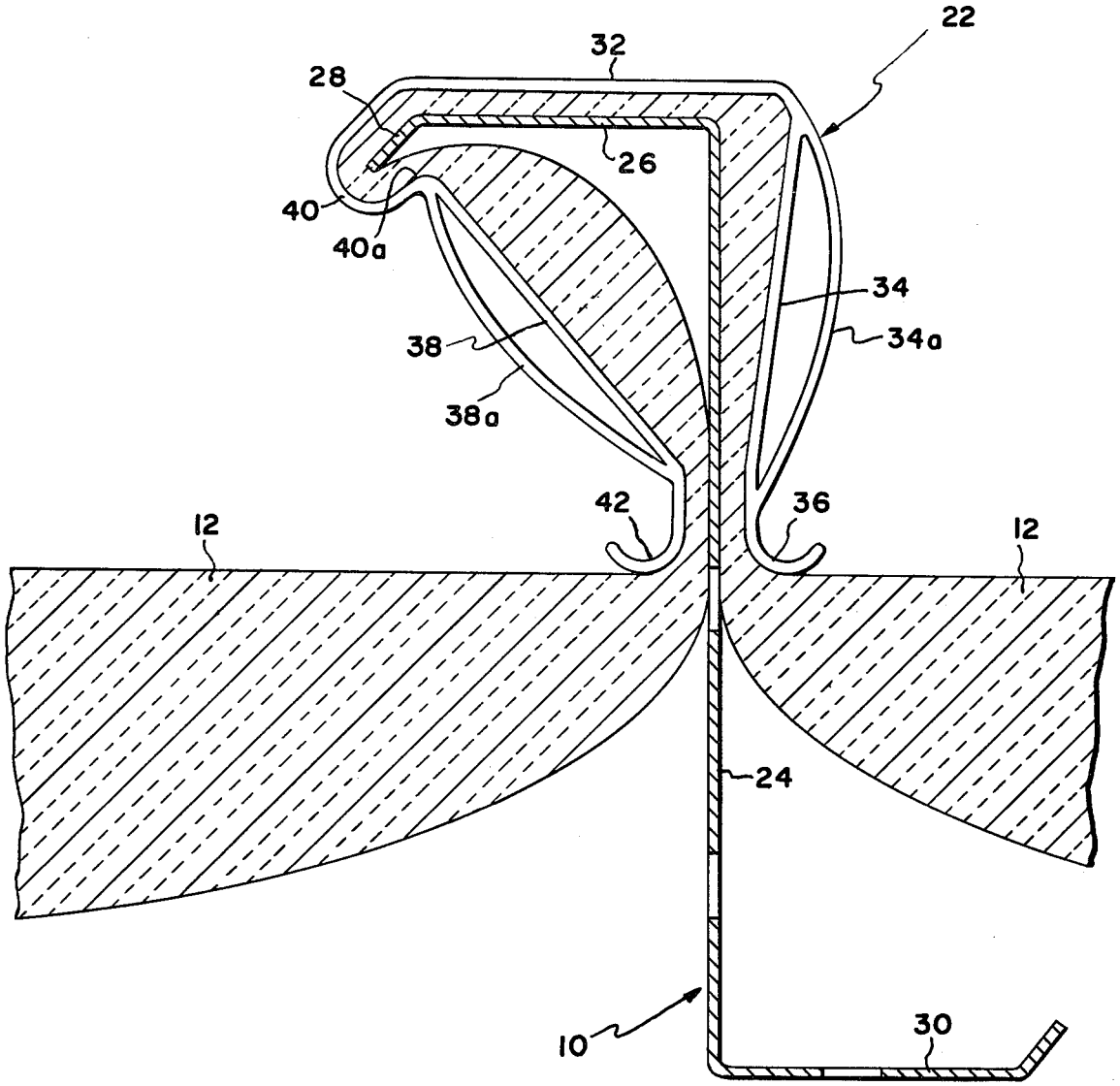

FIG. 1 is a perspective view showing an installation embodying the clip system of the present invention; and FIG. 2 is an enlarged detail cross sectional view showing a clip installed upon a purlin.

Referring first of all to FIG. 1, there is shown a portion of a standing seam roof construction embodying the present invention. For purposes of clarity, many conventional elements of the roof construction are not shown. However, the construction illustrated shows a pair of spaced, parallel purlins generally designated 10, over which a blanket of standard roll-type insulating material designated generally 12 has been laid. At spaced positions along each purlin, purlin-embracing clips 22, to be presently described in detail, are deformed to mount on the purlins and clamp the blanket strips 12 thereto. Also roof panel mounting clips designated generally 14 are mounted on top of certain of the clips 22 and secured to the underlying purlin 10 by self tapping sheet metal screws 16 which pass through openings in the clips 22 and through the blanket 12, and are threaded into the horizontal upper web of the purlin. The mounting clips 14 are employed to mount the standing seam roof panels designated generally 18. For further details of the clips 14 and roof panels 18, reference may be had to a commonly owned copending application U.S. Ser. No. 183,717 filed Sept. 3, 1980 which I also incorporate herein by reference. Because the insulating blanket 12 is compressed against the top of the purlin by the mounting clips 14 and 22, board-like blocks of a relatively rigid thermal insulating material, such as that sold under the styrofoam trademark, designated generally 20, are placed in overlying relationship with the compressed blanket above the top of each purlin 10 between adjacent mounting clips 14.

Details of the construction of clips 22 and the relationship between the clips, purlins and insulating blanket 12 are best seen in FIG. 2. Referring to FIG. 2, it is seen that the purlin 10 is of generally Z-shaped configuration, conventional in this art, which includes are vertical web 24 having an integral horizontal top web 26 projecting to one side of web 24 at its upper edge, the distal end of the horizontal web 26 being bent downwardly and outwardly to form a stiffening flange or lip 28. A similar horizontal web and lip designated generally 30 is formed at the lower end of vertical web 24 to provide a surface for mounting the purlin upon a roof truss, not shown.

The clip 22 is formed and dimensioned to substantially enclose, or surround, approximately the upper half portion of the purlin with a clearance sufficient to accommodate a compressed portion of the insulating blanket 12 between the clip and purlin. The clip includes a top web section 32 which is integrally joined at its right-hand end as viewed in FIG. 2 to a generally vertical side web 34 whose lower edge is reversely bent convexly downwardly into a generally J-shaped configuration as at 36 to form a smoothly rounded or surfaced lower edge at the bottom of web section 34.

At the opposite or left-hand end, as viewed in FIG. 2, the top web section 32 is integrally joined to a generally downwardly and inwardly inclined retaining web section designated generally 38. The upper end of retaining web 38 is formed into a generally U-shaped section 40 which generally envelopes the purlin lip 28. The upper terminus 40*a* of section 40 at about the level of the terminal edge of flange 38 is formed so the blanket 12 is forced to take a reverse direction and hook around the lower edge of flange 38. At the lower end of retaining web section 38, the section is bent into a short vertical section terminating at a lower edge of generally J-shaped configuration 42 forming a smoothly rounded or surfaced lower edge on the retaining web section.

Both vertical web section 34 and retaining web section 38 are provided with an integral bracing or reinforcing web as at 34*a* and 38*a* to strengthen these webs and to apply a firm grip between the upper and lower ends of the web which tends to prevent separation of the ends 36 and 42.

The top of web 32 may be coated with adhesive as at A or alternatively formed with sharp projections to anchor foam blocks 20 in position.

The clip 22 is preferably constructed of a suitable thermoplastic material such as polyvinylchloride which allows the various web sections of the clip to be bent resiliently by an amount sufficient to enable the clip to be snapped into the position shown in FIG. 2 without exceeding the elastic limit of the material. As is apparent from FIG. 2, installation of the clip clamps the insulating blanket 12 as shown to the top and to the opposite sides of the upper portion of the purlin which has the effect of depressing the upper surface of blanket 12 a substantial distance below the top of the purlins 22. As best seen in FIG. 1, this forms pockets P in blanket 12 between adjacent purlins 22 which are suitable for the reception of batts of insulating material, typically unfaced fiberglass 43.

While dimensions of different installations may vary, typical dimensions of the installation shown in FIGS. 1 and 2 are as follows. The total vertical height of purlin 10 is ten inches, the depth of the pocket P formed by the depression of blanket 12 below the purlin tops by clips 22 may be approximately five inches, the blanket 12 is approximately three inches in thickness, while the fiberglass batt is of six inch thickness, the styrofoam board 20 being approximately one inch thick.

With an installation of the foregoing dimensions, it is thus seen that effectively a nine inch thickness of insulation is achieved by the employment of the clip 22 to form pockets in a three inch blanket into which unfaced fiberglass batts of six inch thickness may be simply placed during the assembly of the roof.

While one embodiment of the invention has been described in detail, it will be apparent to those skilled in the art that the disclosed embodiment may be modified. Therefore, the foregoing description is to be considered exemplary, rather than limiting, and the true scope of the invention is that defined in the following claims.

What is claimed is:

1. In a standing seam roof construction including a plurality of elongate parallel purlins, each having a vertical web and a horizontal top web projecting from one side of said vertical web at the upper edge thereof, standing seam roof panels supported by the purlins in overlying relationship therewith, a continuous blanket of deformable, squeezable insulating material spanning a plurality of said purlins and overlying and supported by said purlins; resilient generally inversely U-shaped clips for securing said blanket in overlying relation to said purlins, each clip comprising a horizontal top web section integrally joined at one end to a vertical web section and integrally joined at its other end to a downwardly directed web portion connected with a web loop portion having an upwardly directed web section and then a downwardly directed web section to resiliently enclose the upper portion of the purlin, the web sections of each clip being dimensioned relative to the webs of a purlin such that a blanket of said insulating material overlying a purlin is compressed against the top web of the purlin, and turned reversely by said loop portion, while being pressed against the vertical web of said purlin by the respective top and vertical web sections of said clip to clamp said blanket in position with the top and vertical web sections respectively of the clip opposed to and embracing the top and vertical webs of said purlin; said clips being installed along each of said purlins whereby the blanket in its extent between adjacent purlins is deformed below the tops of the purlins to form pockets between the purlins suitable for the reception of additional insulating material.

2. The invention defined in claim 1 wherein said clip further comprises integral downwardly convex edges of generally J-shaped cross section at the lower ends of said vertical and said downwardly directed web sections.

3. The invention defined in either of claims 1 and 2 wherein the lower ends of said vertical web section and said downwardly directed web section are at substantially the same distance below said top web section and said distance is approximately equal to one-half of the height of the vertical web of said purlin.

4. The invention defined in claim 1 further comprising upwardly projecting means on said top web section of said clip for anchoring a board-like block of insulating material against sliding movement relative to said top web section.

5. The invention defined in claim 1 wherein said top web of said purlin is formed with an outwardly and downwardly inclined lip along its outer edge, and said loop portion of said clip generally surrounds said lip.

6. In a standing seam roof construction including a plurality of elongate parallel purlins, each having a vertical web and an integral horizontal top web projecting from one side of said vertical web along the upper edge thereof, standing seam roof panels supported by the purlins in overlying relationship therewith; a blanket of deformable squeezable insulating material overlying and supported by said purlins and means for anchoring said blanket to said purlins; the improvement wherein said means comprises a plurality of installation clips, each of said clips comprising a member of resiliently bendable material having a top web section integrally joined at one end to a vertical web section and integrally joined at its other end to an inwardly and downwardly inclined retaining web section adapted to resiliently enclose the top web and upper portion of the vertical web of one of said purlins to clamp a portion of said blanket between the clip and the purlin with the blanket compressed against the opposite sides and top of the purlin, said clips being installed at spaced locations along each of said purlins whereby the blanket in its extent between adjacent purlins is depressed by said clips below the tops of the purlins to form a pocket suitable for the reception of a batt of insulating material.

7. The invention defined in claim 6 further comprising a reversely, upwardly bent portion at the lower end of each of the vertical and retaining web sections of said clip defining a smoothly rounded lower edge on each of the last-mentioned web sections.

8. The invention defined in either of claims 6 or 7 further comprising means on the upper surface of the top web section of said clip for anchoring a block of insulating material to the top of said clip.

9. The invention defined in either of claims 6 or 7 wherein the height of said clip is approximately one-half the height of the vertical web of a purlin to which the clip is to be applied.

10. In a system wherein a relatively thick layer of insulating material is applied beneath a sheet metal roof construction; a plurality of spaced parallel purlins with angle-shaped upper ends; sheet metal roof paneling supported by said purlins at a spaced distance above the purlins; a longitudinally extending blanket of roll type insulating material laid crosswisely over a plurality of said purlins, a plurality of clips in overlying relationship to the blanket mounted at spaced locations along each purlin to anchor the blanket thereto and form a depressed pocket in said blanket in its extent between adjacent purlins, and a layer of additional insulating material disposed to fill each pocket; said clips being formed of resilient material to conform generally to the shape of the upper portions of said purlins and being deformed to embrace said purlins so that they clamp the blanket in position and are themselves held in fixed position on the purlins.

11. The system of claim 10 wherein foam boards are secured to the purlins in superjacent relation to the blanket portions overlying the purlins.

12. In a standing seam roof construction including a plurality of elongate parallel purlins, each having a vertical web and a horizontal top web projecting from one side of said vertical web at the upper edge thereof, and a continuous blanket of deformable, squeezable insulating material extending crosswisely to said purlins and overlying and supported by a first purlin to extend beyond the purlin to similarly overlie adjacent purlins; generally inversely U-shaped clips for securing said blanket in overlying relation to said purlins, said clips each having a horizontal top web section integrally joined to downwardly directed web sections at opposite ends, the web sections of each clip being dimensioned relative to the webs of a purlin such that a blanket of said insulating material overlying said purlin is clamped against the top web of the purlin and held adjacent the two opposite sides of the vertical web of said purlin by the respective web sections of each clip to form a recessed channel in said blanket between purlins, and an additional overlying layer of insulating material disposed in said channel.

* * * * *